US005112246A

United States Patent [19]

Kawase et al.

[11] Patent Number: 5,112,246

[45] Date of Patent: May 12, 1992

[54] METHOD OF DETECTING A FITTINGLY LOCKED STATE OF A CONNECTOR AND A CONNECTOR EMPLOYING THE METHOD

[75] Inventors: Hajime Kawase, Mie; Takeshi Kawasumi, Ohita, both of Japan

[73] Assignee: Sumitomo Wiring System, Ltd., Mie, Japan

[21] Appl. No.: 638,532

[22] Filed: Jan. 8, 1991

[30] Foreign Application Priority Data

Jan. 8, 1990 [JP] Japan ..... 2-2140

[51] Int. Cl.[5] ..... H01R 3/00

[52] U.S. Cl. ..... 439/489; 439/188

[58] Field of Search ..... 439/188, 488, 489, 490; 200/51 R, 51.09, 512; 340/686, 687

[56] References Cited

U.S. PATENT DOCUMENTS

| | | | |
|---|---|---|---|
| 2,824,183 | 2/1958 | Marasco et al. | 200/51.09 |
| 3,851,946 | 12/1974 | Piaget et al. | 439/489 X |
| 4,386,818 | 6/1983 | Millhimes et al. | 439/490 |
| 4,602,135 | 7/1986 | Phalen | 200/512 X |
| 4,786,258 | 11/1988 | Shaffer et al. | 439/188 |
| 4,915,648 | 4/1990 | Takase et al. | 439/490 |
| 4,915,649 | 4/1990 | Shimazu et al. | 439/489 X |

FOREIGN PATENT DOCUMENTS

| | | | |
|---|---|---|---|
| 236923 | 9/1987 | European Pat. Off. . | |
| 300767 | 1/1989 | European Pat. Off. . | |
| 2843247 | 4/1980 | Fed. Rep. of Germany | 439/489 |
| 3839728 | 6/1989 | Fed. Rep. of Germany . | |
| WO88/09070 | 11/1988 | PCT Int'l Appl. . | |

*Primary Examiner*—Neil Abrams
*Assistant Examiner*—Khiem Nguyen
*Attorney, Agent, or Firm*—Wenderoth, Lind & Ponack

[57] ABSTRACT

The fittingly locked state of a connector in which a fitted posture is locked by a lock arm of one of two connector housings when the lock arm is brought into engagement with a locking portion of the other connector housing is detected through a method wherein a pressure sensing switch element is mounted on the other connector housing in such a manner as to face the underside of the lock arm in fitted posture. A pair of electricity conducting plates of the pressure sensing switch element are connected to electricity conducting cords drawn from the connector housings via detecting terminals. The pressure sensing switch is switched on when the pressure sensing switch is pressed down by the lock arm, whereby a relative electrical communication is established between the electricity conducting cords, thereby making it possible to detect a proper locked state of the connector housings.

8 Claims, 8 Drawing Sheets

METHOD OF DETECTING A FITTINGLY LOCKED STATE OF A CONNECTOR AND A CONNECTOR EMPLOYING THE METHOD

BACKGROUND OF THE INVENTION

1. Field of the Invention

The present invention relates to a method of detecting a fittingly locked state of a connector, intended to confirm whether or not a pair of female and male connector housings are in a proper locked state when fitting the two connector housings together for connection and locking them in a fitted posture, and also relates to a connector employing the method.

2. Statement of the Prior Art

Generally, a fitted-posture locking mechanism is provided on a pair of female and male connector housings that are fitted together for connection for locking the two conductor housings together in such a proper fitted posture. However, it often happens that the two connector housings are brought into use while they are in a semi-fitted state in which the connector housings are not fully fitted together, or in a state in which a locking operation is not being properly performed, thereby causing electrical failures while in use. This is due to the fact that a certain magnitude of insertion force is required to fit the connector housings together and that the locking mechanism is subject to deformation and/or breakage.

With a view to solving the above problem, the official gazette of Japanese Utility Model Laid-Open No. 16080/1989 discloses a connector provided with an electrical detecting mechanism for detecting the above-mentioned semi-fitted state, or state in which a locking operation is not being properly performed, in a simple fashion. Namely, in this connector, a "metal contact plate extending from a substrate in a cantilever-like fashion and having bifurcated contact portions at a free end thereof" is provided on one of the connector housings, and one of the contact portions at the free end is press held by the leading end of a lock arm of the other connector housing that is properly fitted in one of the connector housings onto an electricity detecting conducting terminal provided therebelow, while the other contact portion at the free end is always kept in contact with another electricity detecting conducting terminal, thereby making it possible to detect a proper operation of the lock arm through the relative electricity conduction between these two electricity conducting terminals.

In this prior art detecting mechanism, since one of the bifurcated contact portions at the free end that protrudes from the common proximal portion is elastically deformed by the lock arm so as to be forcibly brought into contact with the electricity conducting terminal, while the other contact portion at the free end is biased to be kept in contact with the other electricity conducting terminal, the metal contact plate is displaced in a direction in which it inclines every time the connector housings are fitted together, with one of the contact portions at the free end being press-held and the other contact portion being floated. Moreover, the leading end of the metal contact plate that is subject to external force is easy to be deformed. This often causes contact errors between the contact portions at the free end and the electricity conducting terminals, and thus this prior art detecting mechanism has a drawback in that it lacks durability and reliability in its detecting performance.

SUMMARY OF THE INVENTION

An object of the present invention is to obtain a method of detecting a fitted state of a connector that can improve the durability of a detecting mechanism and the reliability in the detecting performance of the detecting mechanism, and a connector employing the method.

Another object of the present invention is to structurally stabilize a fitted-posture locking mechanism in the above method and connector.

A further object of the present invention is to improve the quality of the above connector.

In order to accomplish the above technical objects, the present invention provides a method of detecting a fitted state of a connector in which a fitted posture is locked by a lock arm of one of two connector housings when it is brought into engagement with the locking portion of the other connector housing, wherein a pressure sensing switch element is mounted on the other connector housing in such a manner as to face the underside of the lock arm in a fitted posture. A pair of electricity conducting plates of the pressure sensing switch element are connected to electricity conducting cords drawn from the connector housings via detecting terminals, wherein the pressure sensing switch is switched on when it is pressed by the lock arm. An electricity conduction produced when the pressure sensing switch is switched on is transferred to the electricity conducting cords via the detecting terminals, and a proper fittingly locked state of the connector housings is detected through electricity conduction relative to the electricity conducting cords.

The present invention also provides a connector employing the above detecting method that is mainly constituted by two connector housings, wherein one of the connector housings in which an operating portion is provided on a lock arm is combined with the other connector housing in which a detecting electricity conducting body having a pressure sensing switch element is mounted thereon in such a manner as to face the lock arm, and a pair of detecting terminals having electricity conducting cords are also provided.

In the method of detecting a fitted state of a connector according to the present invention, as well as a connector employing the same method also according to the present invention, both being constructed as described above, the pressure sensing switch element is used as a switch for detecting a proper fitted state of a connector, and the pressure sensing switch element is pressed to be switched on by the lock arm when it is put into the fitted posture. This switching operation is then transferred to the electricity conducting cords via the junction terminals for detection. Due to this, the pressure sensing switch element acting as a section where a detection takes place has extremely good durability and a quality enabling the continuity of a precise switching operation. Moreover, the position of the detecting terminals that are provided downstream of the pressure sensing switch element to relay and transfer the switching operation of the switching element is not subject to external influences such as external pressing. Due to this, a stable transfer operation can be attained. Therefore, an electric signal indicating a fittingly locked state sent from the lock arm is extremely accurately transferred to the electricity conducting cords, and this serves to highly improve and stabilize the accuracy with which whether or not the connector housings are in a proper fittingly locked state is detected. Moreover, this also serves to enable the detecting performance of the detecting terminals to continue with good durability.

BRIEF DESCRIPTION OF THE DRAWINGS

FIGS. 1(A), 1(B) and 1(C) show a first embodiment of a connector according to the present invention, wherein FIG. 1(A) is a perspective view showing the whole view of the connector, FIG. 1(B) is a front view showing a fitted state of the connector, and FIG. 1(C) is a side view showing a state in which a pressure sensing switch element portion is in operation;

FIGS. 2(A), 2(B) and 2(C) show an electricity detecting conducting body of the embodiment shown in FIG. 1, wherein FIG. 2(A) is a front view thereof, FIG. 2(B) is a plan view thereof, and FIG. 2(C) is a side view thereof;

FIGS. 4(A) and 4(B) show a second embodiment of the connector according to the present invention, wherein FIG. 4(A) is a perspective view thereof, and FIG. 4(B) is a front view showing a fitted state of the connector.

DETAILED DESCRIPTION OF THE PREFERRED EMBODIMENTS

Figure 1A:
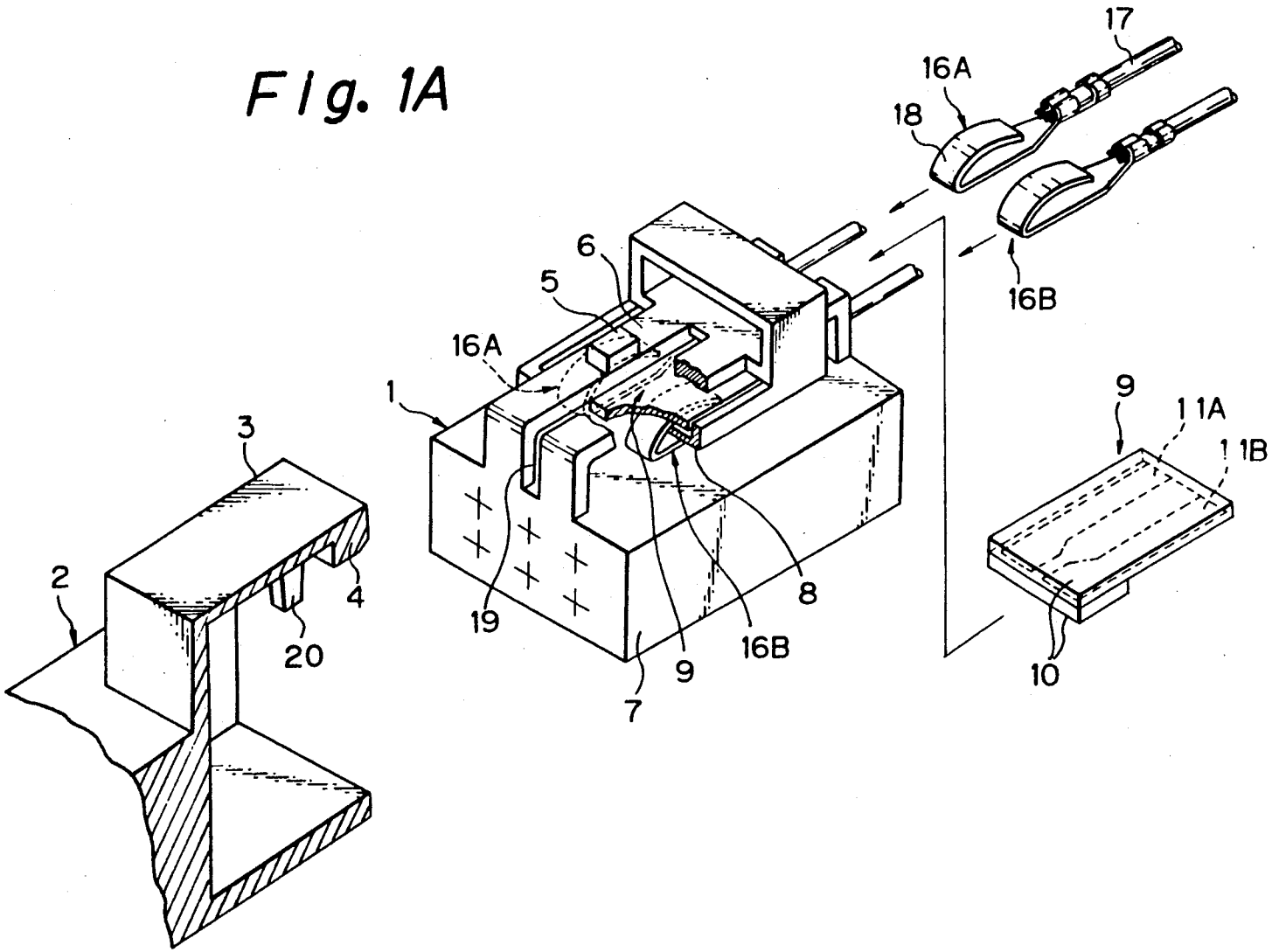

Referring to the drawings, embodiments of a connector according to the present invention will be described below.

Figure 1B:
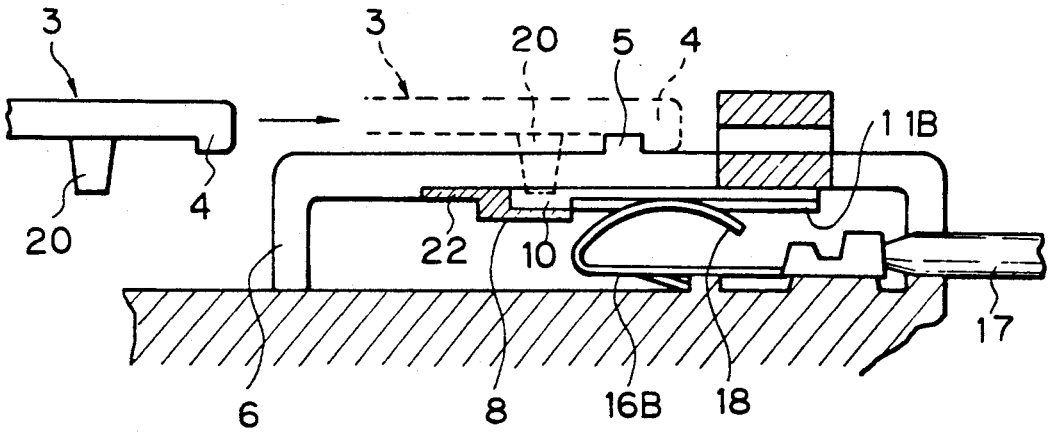
Figure 1C:
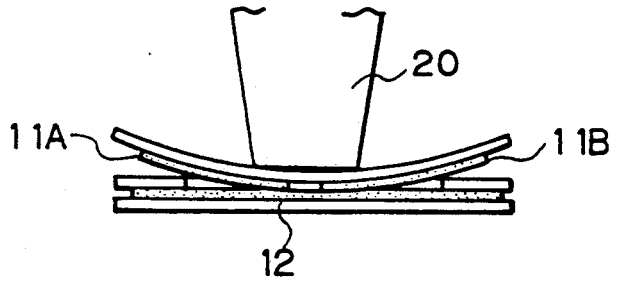
Figure 2A:
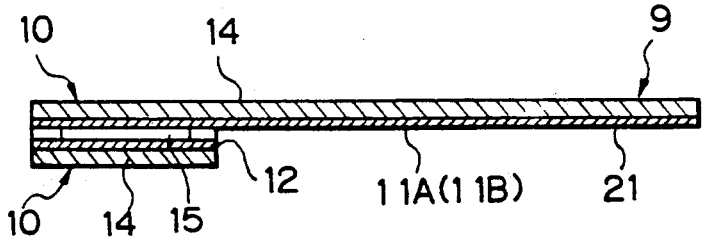
Figure 2B:
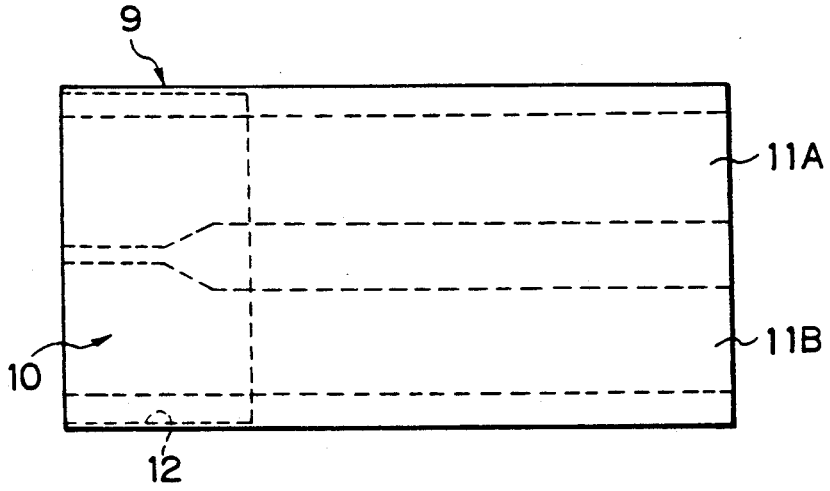
Figure 2C:
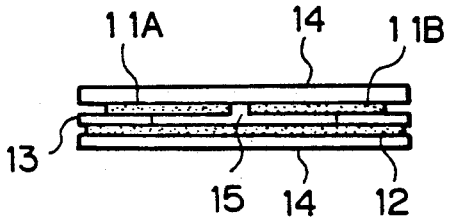

First, referring to FIGS. 1 to 3 showing a first embodiment of the present invention, in a connector with a fitted-posture locking mechanism, the front half portion of a female connector housing 1 accommodating therein female terminals (not shown) and a male connector housing 2 accommodating therein male terminals (not shown) are fitted together for connection. At this time a locking projection 4 formed on the leading end of a lock arm 3 provided front-ward on the male connector housing 2 is brought into engagement with locking portions 5 provided on a locking elastic arm 6 bridged longitudinally on the female connector housing 1 at an intermediate position along the length thereof in such a manner as to project therefrom so that the female and male connector housings are locked in a proper fitted posture.

An electricity conducting body receiving portion 8, formed as an integral part of the locking elastic beam 6, is provided on the female connector housing in a gap provided between the locking elastic beam 6 and the top side of a connector housing main body 7. An electricity detecting conducting body 9, having a pressure sensing switch element 10 at a front end thereof, is mounted on the electricity conducting body receiving portion 8 from the rear thereof. Further, a pair of electricity conducting terminals 16A and 16B to which electricity cords 17 are connected, respectively, are inserted beneath the rear half portion of the electricity detecting conducting body 9 and secured in place therein such that the contact portions 18 of the respective electricity conducting terminals 16A and 16B are brought into contact with a pair of electricity conducting plates 11A and 11B for electricity conduction.

A projecting operating portion 20 is provided on the lock arm 3 of the male connector housing 2 at an intermediate position along the length thereof in such a manner as to project downwardly therefrom. As shown in FIG. 1(B), when the female and male connector housings 1 and 2 are properly fitted together with the locking projection 4 on the lock arm 3 being brought into engagement with the associated locking portion 5 for locking in a fittingly locked posture, the operating portion 20 enters an insertion gap 19 formed at an intermediate position along the width of the locking elastic bridge 6 on the associated connector housing, and presses down the pressure sensing switch element portion 10 of the detecting electricity conducting body 9 to switch on the same, whereby the electricity conducting plates 11A and 11B are electrically connected to each other. This in turn establishes an electrical communication between the electricity conducting terminals 16A and 16B that are in electrical contact with the electricity conducting plates 11A and 11B, thereby making it possible to detect that the female and male connector housings 1 and 2 are in a proper fittingly locked state.

As shown in FIG. 2, the electricity detecting conducting body 9 has the pressure sensing switch element portion 10 comprising a known pressure sensing switch element structure constituted by a combination of the pair of electricity conducting plates 11A and 11B arranged in parallel and a single communicating plate 12 arranged so as to face the electricity conducting plates 11A and 11B via a clearance 15 in a transverse direction. As shown in FIG. 1(C), when the pressure sensing switch element portion 10 is forcibly pressed down by the operating portion 20, the electricity conducting plates 11A and 11B are brought into contact with the communicating plate 12 so as to generate an electricity conduction therebetween, while the electricity conducting plates 11A and 11B and the communicating plate 12 separate from each other when the operating portion 20 is not pressed down, remaining in a free state. These electricity conducting plates 11A and 11B extend rearwardly from the pressure sensing switch element portion 10 so as to be formed into the plate-like electricity detecting electricity conducting body 9 that forms an associated contact portion 21 to which the detecting terminals 16A and 16B are brought into contact. In FIG. 2, reference numeral 13 denotes a liner for the clearance 15 and reference numeral 14 a protection film for the electricity conducting plates 11A and 11B and the communicating plate 12.

The connector according to the embodiment shown in FIGS. 1 and 2 functions as follows.

Figure 3A:
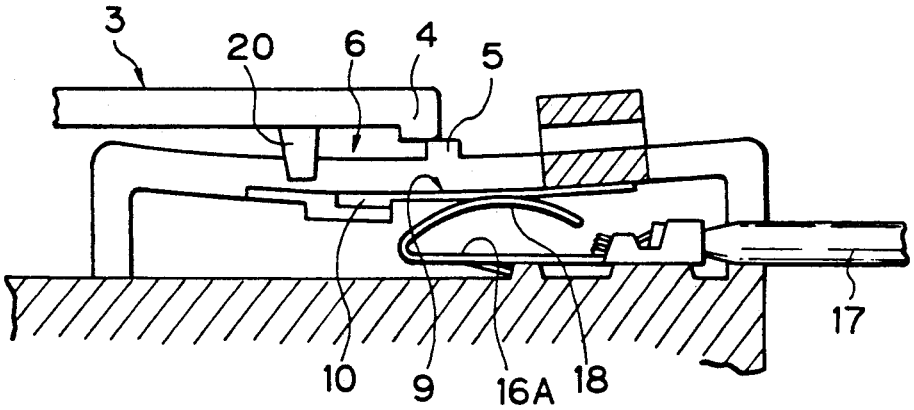
FIGS. 3(A), (B), (C) and (D) are front views showing states in which the embodiment of FIG. 1 is in operation.

Referring to FIG. 3 showing a state of the connector in operation, when the female and male connector housings 1 and 2 start to be fitted together, as shown in FIGS. 3(A) and (B), the locking projection 4 of the lock arm 3 comes into a physical collision with the locking portion 5 of the locking elastic beam 6 so as to elastically flex the locking elastic beam 6, and this allows the locking projection 4 to pass over the locking portion 5. During this operation, the operating portion 20 does not come into a physical collision with the pressure sensing switch element portion 10 being lowered together with the locking elastic beam 6.

Figure 3B:
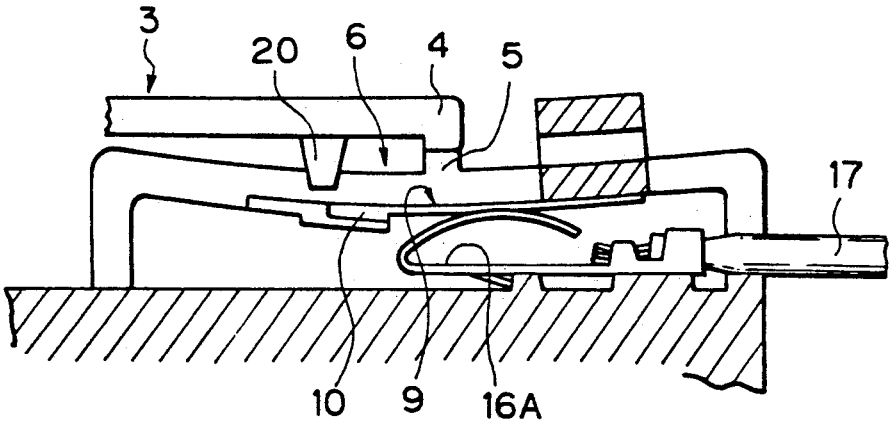
Figure 3C:
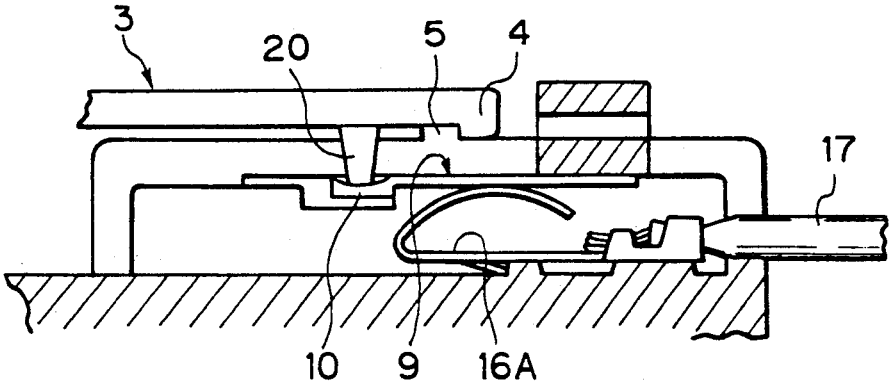

Following this, when the locking projection 4 and the locking portion 5 are brought into meshing engagement with each other at a fitting final position, as shown in FIG. 3(C), the downward displacement of the locking elastic beam 6 is then released and the locking elastic beam 6 is restored to its original position, and the operating portion 20 located above the pressure sensing switch element portion 10 presses down the center of the pressure sensing switch element portion 10 that has been restored to its upper position, whereby the electricity conducting plates 11A and 11B are electrically communicated to each other to thereby generate an electrical conduction between the electricity conducting cords 17, thereby enablirg the lock arm 3 to detect that the fitted posture has been properly locked.

In contrast, as shown in FIGS. 3(A), 3(B), in a case where the connector housings are in a semi-fitted state, the pressure sensing switch element portion 10 is not pressed down and therefore is not switched on, and hence no electricity conduction between the electricity conducting cords 17 is generated, whereby an error in locking a fitted posture is confirmed. The above-mentioned high performance of the detecting function is thus exhibited.

Figure 3D:
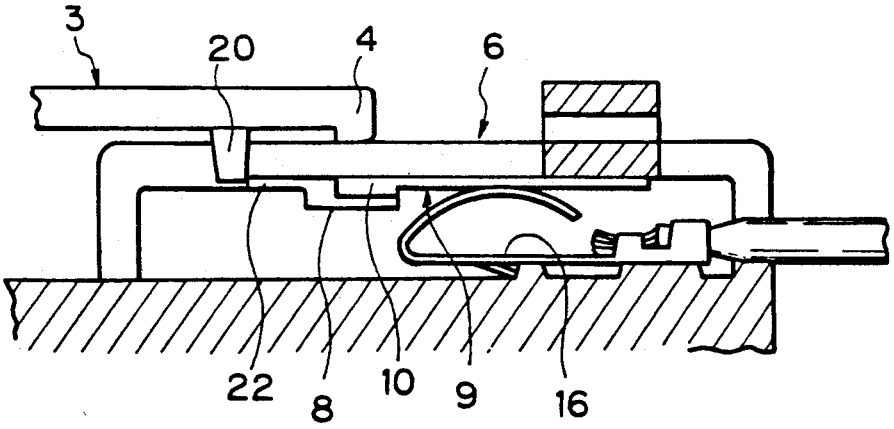

Furthermore, in the pressure sensing switch element portion 10 of the embodiment shown in FIG. 1, as shown in FIG. 1(B), since a barrier portion 22 accommodating the top surface of the pressure sensing switch element portion 10 is provided on the front edge of the electricity conducting body receiving portion 8, in a case where the locking mechanism is out of order due to the lack or breakage of the locking portion 5 of the locking elastic beam 6, caused by some reason, as shown in FIG. 3(D), the locking elastic beam 6 is not at all displaced downwardly or is displaced insufficiently, and the lower most end of the operating portion 20 comes into a physical collision with the barrier portion 22 to thereby check the advance of the lock arm 3, thereby making it possible to accurately detect the failure of the locking elastic beam 6.

Next, referring to FIG. 4, a second embodiment of the present invention will be described below. In this second embodiment, similarly, the electricity detecting conducting body 9 having the pressure sensing switch element portion 10 and the detecting terminals 16A and 16B intended to be brought into contact with the pair of electricity conducting plates 11A and 11B of the electricity detecting conducting body 9 for electricity conduction are provided on one of connector housings, but the detecting electricity conducting body 9 is folded into a U shape at an intermediate position along the length thereof. It is inserted from the rear of the locking elastic beam 6 so as to be secured in place such that a contact portion 18 of the electricity conducting terminals 16A, 16B is brought into press contact with the electricity conducting plates 11A and 11B exposed on the lower outside of the detecting electricity conducting body 9.

This contact portion 18 is formed into a spring contact portion 18' having a biasing force for upwardly biasing the locking elastic beam 6 from below as well as an elastically pressing force required to press contact the contact portion 18 against the electricity conducting plates 11A and 11B.

The lock arm 3 of this second embodiment has a configuration defined by a locking projection 4 provided at the leading end thereof and an operating portion 20 provided at the center of the locking projection 4 in such a manner as to project therefrom, and this operating portion 20 is constructed so as to press down the pressure sensing switch element portion 10 when the locking projection 4 is properly locked.

Figure 4A:
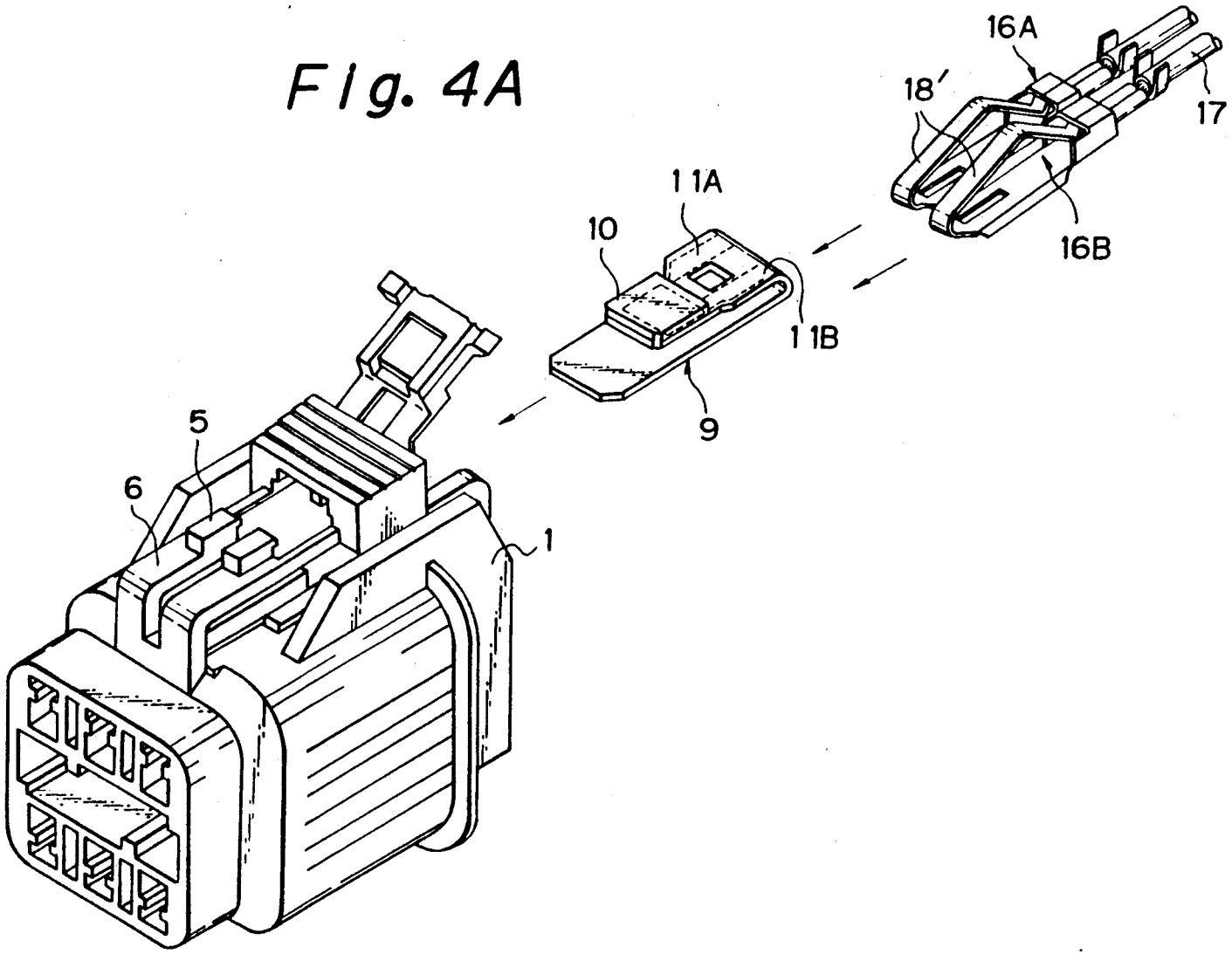
Figure 4B:
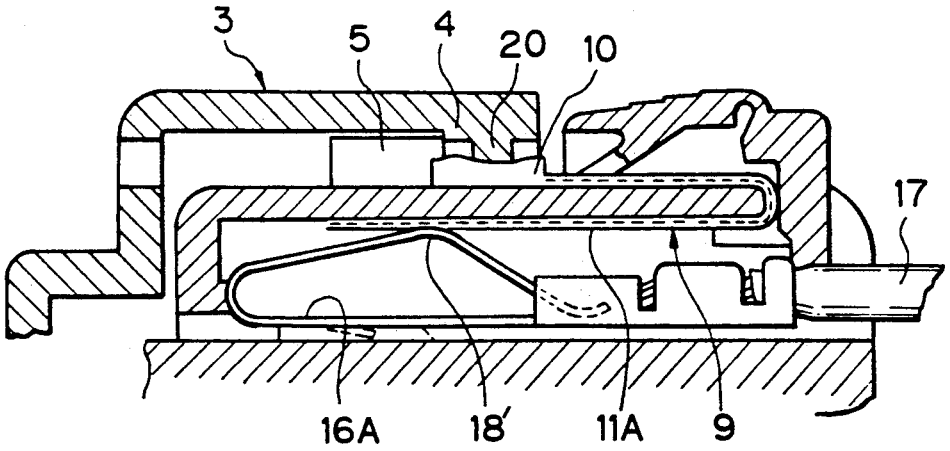

According to the embodiment shown in FIG. 4, in addition to the detecting function of the connector of the present invention, another function is provided on the connector for preventing the deterioration or forfeiture of a locking function that would be caused when the locking elastic beam 6, which is in a pre-fitted state, is downwardly plastically deformed by virture of a detrimental external force (actually, this downward plastic deformation of the locking elastic beam 6 quite frequently takes place in relation to normal connectors).

Figure 5:
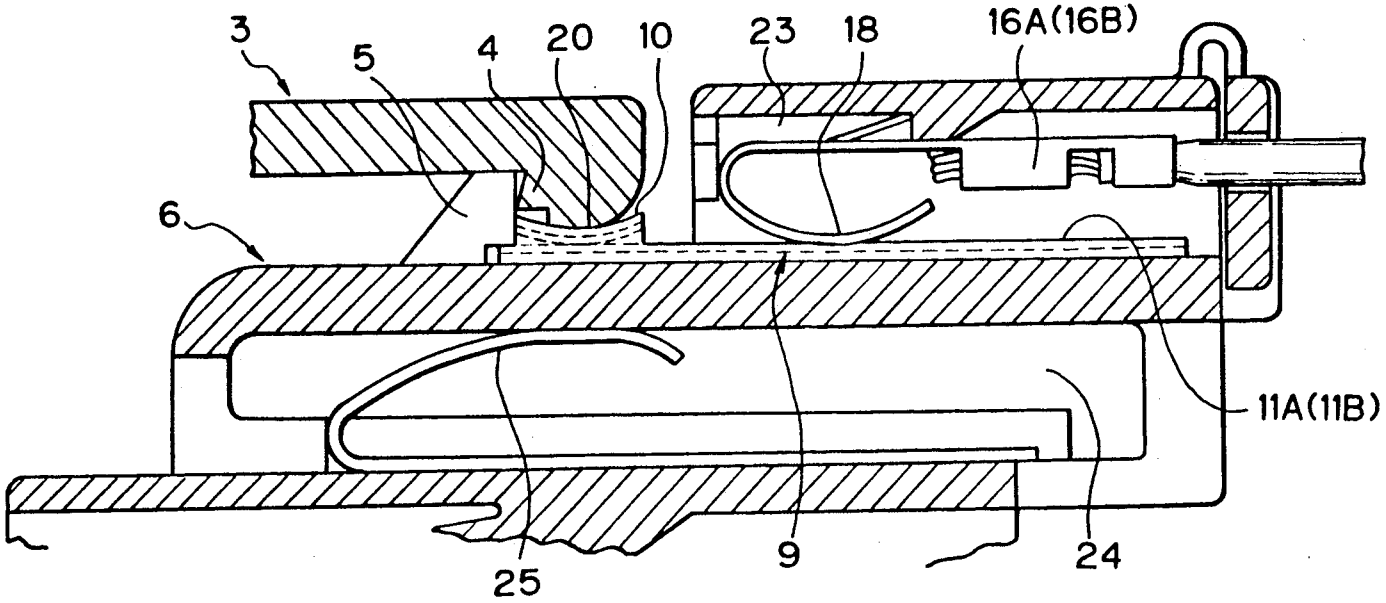
FIG. 5 is a front view of a third embodiment of the connector according to the present invention.

FIG. 5 shows a third embodiment of the present invention, in which the biasing means for lifting up the locking elastic beam 6 of the second embodiment is formed as an independent member with a view to further improving the function thereof. To be precise, a detecting terminal accommodation chamber 23 is provided on the locking elastic beam 6, and the detecting terminals 16A and 16B are mounted therein such that the contact portion 18 faces downwardly. The detecting electricity conducting body 9 is laid out in the detecting terminal accommodation chamber 23 with the rear half of the electricity conducting plates 11A and 11B being exposed upwardly, and the pressure sensing switch element portion 10 is laid out between the locking portion 5 of the locking elastic beam 6 and the front edge of the detecting terminal accommodation chamber 23 so as to be pressed down by the operating portion 20 of the lock arm 3 of the associated connector housing. A biasing spring body 25 having a biasing force for lifting up the locking elastic beam 6 from below is mounted in a gap 24 formed beneath the locking elastic beam 6.

According to the third embodiment shown in FIG. 5, since this biasing spring body 25 functions exclusively to prevent the plastic deformation of the locking elastic beam 6, the function and effectiveness of preventing such deformation can be further improved.

As described above, the method of detecting a fittingly locked state of a connector and the connector employing the same method, both according to the present invention, have superior detecting accuracy with which whether connector housings are in a proper fittingly locked state or in a semi-fitted state in which the connector housings fail to be properly fitted together is detected in a precise manner, as well as the detecting performance enabling such detecting accuracy to continue with good durability, whereby the reliability in detecting a fittingly locked state of a connector is improved, while the structure of the fitted-posture locking mechanism is stabilized. Thus, the method and connector employing the method according to the present invention is advantageous in that they serve to improve the quality of connectors.

What is claimed is:

1. A connector, comprising:

first and second connector housings for connection to each other;

a locking mechanism, said locking mechanism comprising a lock arm disposed on said first connector housing, said lock arm having a leading end with a locking projection formed thereon, and an elastic locking beam provided on said second connector housing, said elastic locking beam having a locking portion formed thereon, whereby said connector housings can be locked together in a fitted posture by engaging said locking projection of said lock arm with said locking portion on said elastic beam when said connector housings are connected to each other; and a detecting mechanism for detecting when said connector housings are locked together in a fitted posture, said detecting mechanism comprising:

an operating portion provided on said lock arm, an electricity detecting conducting body having a pressure sensing switch element portion and a pair of electricity conducting plates extending rearwardly therefrom, said electricity conducting body being disposed on said elastic locking beam such that said pressure sensing switch element faces said operating portion of said lock arm when said connector housings are locked together in a fitted posture, a pair of detecting terminals having respective contact portions for elastically contacting respective said electricity conducting plates, and a pair of electricity conducting cords connected to respective said detecting terminals, whereby said pressure sensing switch element portion is pressed by said operating portion when said connector housings are locked together in a fitted posture to establish relative electrical communication between said electricity conducting cords through said detecting terminals.

2. The connector of claim 1, wherein:

said pair of detecting terminals are mounted between a side wall of the body of said second connector housing and said elastic locking beam; and said contact portions of said detecting terminals are spring biased contact portions biasing said elastic locking beam away from said body of said second connector housing.

3. The connector of claim 2, wherein said elastic locking beam comprises a beam spaced from said body, extending parallel thereto, and mounted at opposite ends to said body.

4. The connector of claim 3, wherein said elastic locking beam comprises an electricity conducting body receiving portion for receiving and holding said electricity detecting conducting body.

5. The connector of claim 4, wherein said elastic locking arm has an insertion gap extending therealong for receipt of said operating portion so that said operating portion can extend through said insertion gap to contact said pressure sensing switch element portion.

6. The connector of claim 1, wherein:

said second connector housing has a body, said elastic locking beam being mounted on said body and defining a space therebetween;

a biasing spring body is provided in said space biasing said elastic locking beam away from said body; and a detecting terminal accommodating chamber is formed on said elastic locking beam receiving said pair of detecting terminals and covering a rear half portion of said electricity detecting conducting body.

7. The connector of claim 1, wherein said elastic locking beam extends rearwardly on said second connector housing, defining a space therebetween, and said pair of terminals is received in said space.

8. The connector of claim 7, wherein said electricity conducting body has said pressure sensing switch element portion on an upper surface of said elastic locking beam for facing said operating portion of said lock arm and said pair of electricity conducting plates on a lower surface facing said pair of terminals.

* * * * *